US008349247B2

(12) United States Patent
Ueno

(10) Patent No.: US 8,349,247 B2
(45) Date of Patent: Jan. 8, 2013

(54) CONTROLLED COOLING APPARATUS AND COOLING METHOD OF STEEL PLATE

(75) Inventor: Hironori Ueno, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 520 days.

(21) Appl. No.: 12/306,496

(22) PCT Filed: May 11, 2007

(86) PCT No.: PCT/JP2007/060177

§ 371 (c)(1),
(2), (4) Date: Dec. 23, 2008

(87) PCT Pub. No.: WO2008/139632

PCT Pub. Date: Nov. 20, 2008

(65) Prior Publication Data

US 2009/0194917 A1 Aug. 6, 2009

(51) Int. Cl.
*C21B 7/10* (2006.01)

(52) U.S. Cl. ..... 266/46; 266/102

(58) Field of Classification Search ..... 266/44, 266/46, 47, 113, 130, 88, 102, 111; 148/661; 72/201; 239/549–551
See application file for complete search history.

(56) References Cited

U.S. PATENT DOCUMENTS

| | | | | |
|---|---|---|---|---|
| 3,659,428 | A * | 5/1972 | Kunioka et al. | 62/64 |
| 4,511,089 | A * | 4/1985 | Ebata et al. | 239/553.3 |
| 4,575,052 | A * | 3/1986 | Ebata et al. | 266/81 |

FOREIGN PATENT DOCUMENTS

| | | | |
|---|---|---|---|
| JP | 4-55645 | A | 2/1992 |
| JP | 06212279 | * | 8/1994 |
| JP | 9-294943 | A | 11/1997 |
| JP | 10080714 | * | 3/1998 |
| JP | 2004-313933 | A | 11/2004 |
| JP | 2006-219732 | A | 8/2006 |

* cited by examiner

*Primary Examiner* — Scott Kastler
*Assistant Examiner* — Michael Aboagye
(74) *Attorney, Agent, or Firm* — Birch, Stewart, Kolasch & Birch, LLP

(57) ABSTRACT

The present invention provides a steel plate cooling method, in controlled cooling of thick-gauge steel plate, which uniformly cools steel plate over its entire length and eliminates plate warping, that is, a method of conveying and cooling the top and bottom surfaces of steel plate in a high temperature state after hot rolling while constraining the high temperature rolled steel plate by a plurality of sets or top and bottom draining rolls, wherein cooling nozzles having a large number of nozzle openings and individually or simultaneously spraying the two fluids of air and water are used to cool the steel plate, the cooling method of steel plate characterized by giving a stable pattern by driving out air trying to invade the path of flow reaching the front end of the cooling apparatus when the water which is fed is low in amount or low in pressure. Further, the apparatus for working this method is a steel plate cooling apparatus comprised of an outside header having an air feed system, a plurality of air spray nozzles arranged at the air spray surface of this header, an inside header having a cooling water feed system, and a plurality of cooling water spray nozzles arranged at a cooling water spray surface of this header.

1 Claim, 3 Drawing Sheets

CONTROLLED COOLING APPARATUS AND COOLING METHOD OF STEEL PLATE

TECHNICAL FIELD

The present invention relates to a method of controlled cooling of steel plate, in particular relates to an apparatus and method for controlled cooling of steel plate used when hot rolling, then water cooling high temperature state steel plate from the top and bottom directions.

BACKGROUND ART

In recent years, the requirements on the quality of ferrous metal materials such as the precision of plate thickness, material quality, surface grade, etc. have become increasingly severe. In particular, in the case of production of thick-gauge steel plate, a cooling control process using on-line control aimed at reduction of the alloy ingredients, streamlining of the heat treatment process, etc. has been employed. This cooling control process using on-line control cools the thick-gauge steel plate, which is in a high temperature state after hot rolling, immediately or ten or so seconds later by a predetermined cooling rate until a predetermined cooling stop temperature so as to reduce the content of expensive alloy ingredients and still obtain the desired strength, toughness, and rigidity. Usually, in this process, the amount of cooling water and the water cooling time are adjusted to control the cooling rate and the cooling stop temperature respectively.

As the apparatuses used for the above controlled cooling, in general the slit jet cooling method and multi mist jet cooling method are employed, but there are the problems of a narrow effective cooling area, maintenance of a slit clearance in the plate width direction of several millimeters at all times, the location of use, etc. Aerated water cooling nozzles with broad ranges of control of the amounts of water are being extensively employed, but for stable and uniform cooling of steel plate, a high density nozzle arrangement is desirable, but this nozzle configuration and the increased complexity make a box type cooling apparatus necessary. This box type cooling apparatus has the advantage of use of nozzles of a type directly feeding water or air to a plurality of nozzles from a water or air header and therefore a simple structure. As the nozzle configuration of this box type cooling apparatus, as disclosed in Japanese Utility Model Publication (A) No. 63-111208, there is proposed a cooling apparatus comprised of outside and inside headers having respectively independent cooling water feed systems wherein the outside header is provided with a large number of bell mouth nozzles having constricted parts of predetermined angles at the cooling water spray surface and the inside header is provided with a large number of nozzles having tapered curved front ends so as to generate ring shaped impact flows and, as disclosed in Japanese Utility Model Publication (A) No. 1-135108, there is proposed a method of obtaining an excellent cooling performance even under conditions where the pressure of a directly impacting flow and the pressure of a tapered slanted flow are the same by making the orifice size at a discharge port of a bell mouth nozzle simultaneously spraying a directly impacting flow and a slanted flow smaller than the orifice size of a direct impact flow introduction port and tapering the introduction port of the slanted flow.

DISCLOSURE OF THE INVENTION

However, there is the problem that if throttling back the amount of air, the mist spray will become unstable and the desired cooling pattern will not be able to be maintained. In particular, in the case where the feed water pressure becomes low, air invades the path of circulation of water and the mist spray becomes unstable in a so-called "second wind" phenomenon and therefore the cooling becomes extremely unstable.

The present invention provides, in a cooling method of hot rolled steel plate, a cooling apparatus of steel plate giving a stable spray pattern by driving out air trying to invade a path of flow reaching a front end of the cooling apparatus even when the water which is fed is low in amount or low in pressure and a cooling method using the same and has as its gist the following:

(1) A cooling apparatus for mixing and spraying air and water to cool steel plate, said controlled cooling apparatus for steel plate characterized in that said cooling apparatus is provided with an air header for feeding air and a plurality of nozzles connected to this air header, each having an air introduction port at its top, cooling water introduction ports at its body, and a discharge port for spraying air and water at its bottom, the area around the water introduction ports of said nozzles forming a water header, a height of a feed port of a pipe feeding water to that water header being set lower than the heights of water introduction ports of said nozzles, and an air vent valve being provided in the middle of said water feed pipe.

(2) A cooling method of steel plate characterized by using a controlled cooling apparatus as set forth in (1) to start cooling of the steel plate, during which first circulating air to said nozzles, next opening said air vent valve, substantially simultaneously feeding water to said water header, driving out the air mainly in the pipe, and, after this, closing the air vent valve.

(3) A cooling method of steel plate characterized by using a controlled cooling apparatus as set forth in (1) to end the cooling of the steel plate and stop the circulation of air and water, during which first stopping the circulation of water and after this stopping the circulation of air.

BEST MODE FOR CARRYING OUT THE INVENTION

First, the cooling apparatus of steel plate for carrying out the present invention will be briefly explained.

Figure 1:
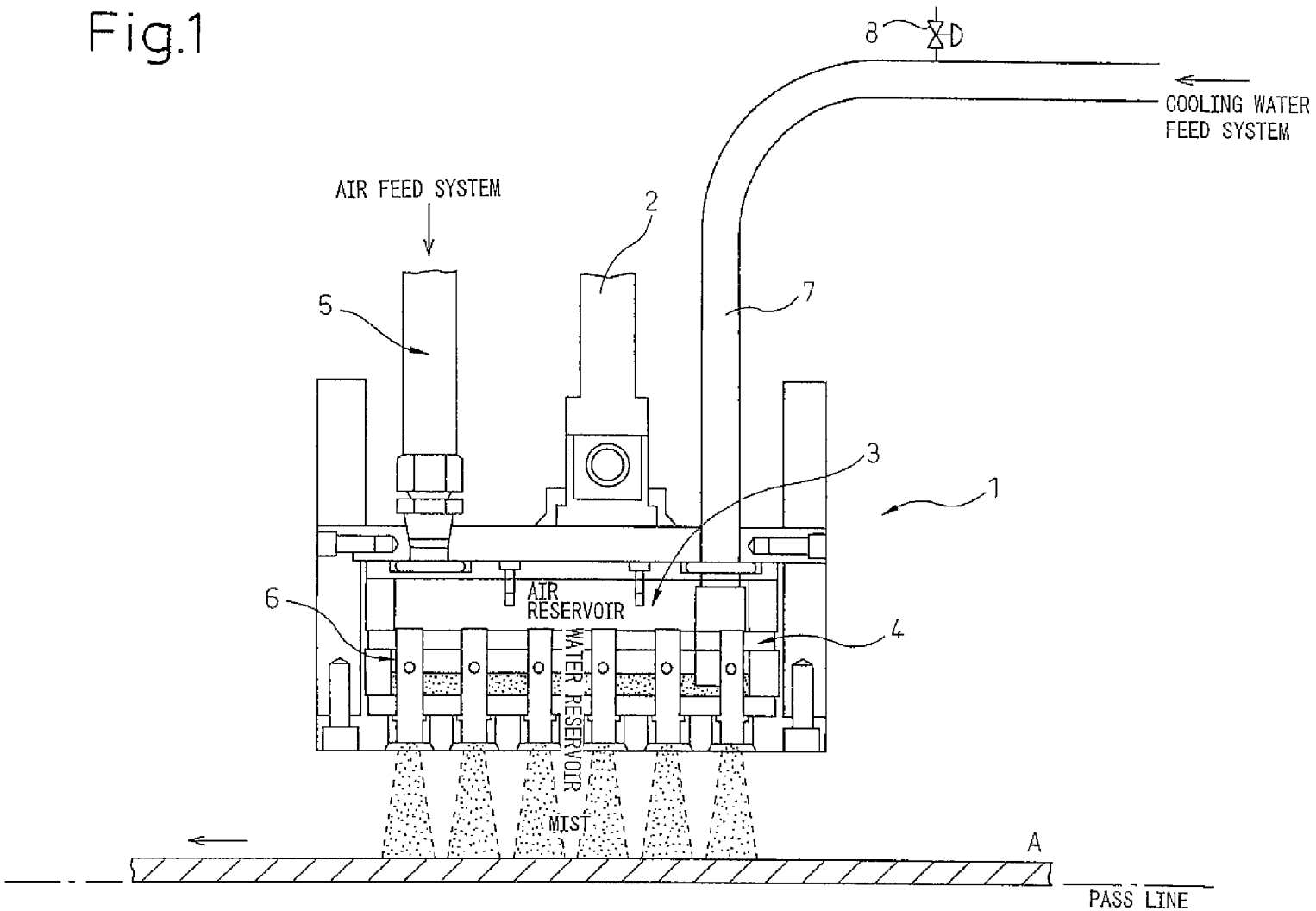
FIG. 1 is a schematic view of the configuration of a steel plate cooling apparatus according to the present invention.
Figure 3:
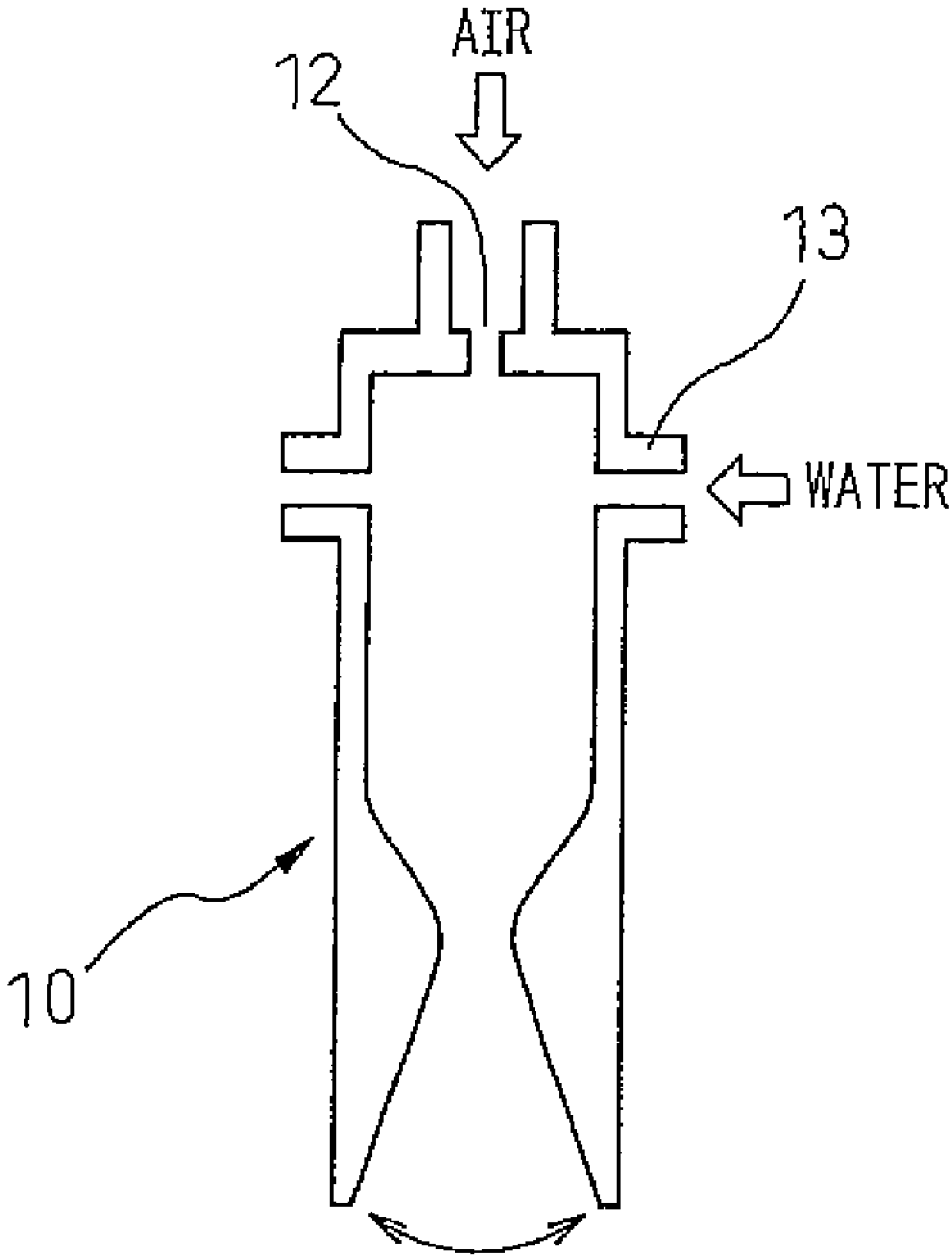
FIG. 3 is a schematic view of the configuration of a spray nozzle used for a steel plate cooling apparatus according to the present invention.

FIG. 1 is a schematic view of the configuration of a cooling apparatus using two fluids, air and water, according to the present invention. In FIG. 1, a cooling apparatus unit 1 arranged above a steel plate A being cooled on a cooling path line is supported by a support apparatus 2. This support apparatus 2 includes an air header 3 and a water header 4. The air header 3 is provided with a plurality of air feed pipes 5 arranged in an orderly manner at an air spraying surface, while the water header is provided with a plurality of cooling water spray nozzles 6 arranged in an orderly manner at the cooling water spraying surface. Each spray nozzle, as shown in FIG. 3, has an air introduction port 12 at its top and water introduction ports 13 at its body part 10. Air and water are mixed in the nozzle and sprayed from a spray hole at the bottom of the nozzle. Further, an air reservoir is formed at the air spray surface of the air header 3, while a cooling water reservoir is formed around the cooling water spray nozzles 6 of the water header 4. The water header 4 has a cooling water feed pipe 7 for feeding cooling water. The height of the outlet of this pipe is positioned lower than the water introduction ports of the spray nozzle 6 bodies. This is because when stopping the water, the water header is filled with air above the water introduction ports of the bodies of the spray nozzles, but if the outlet of the cooling water feed pipe is in that range, the water in the pipe is fed to the inside of the water header and that water further flows out from the nozzles, so the response when stopping the cooling water becomes poor. To avoid this, the pipe outlet is arranged to be constantly immersed in water, that is, below the water introduction ports of the spray nozzle bodies.

Further, in the middle of the cooling water feed pipe 7, an air vent valve 8 is provided. This smoothly vents air invading the pipe. A conventional cooling apparatus using the two fluids of air and water is controlled so that the amount and pressure of the air fed from the air feed system and the amount and pressure of the cooling water fed from the cooling water feed system are adjusted in accordance with a preset cooling rate and uniform cooling is performed.

However, as explained above, when an abnormal situation arises where the water which is fed becomes low in amount or low in pressure, the ratio of mixture of the air in the cooling water will become higher, the amount of consumption of air will increase, the running costs will swell, and, there is the problem that if throttling back the amount of air, the mist spray will become unstable and the desired cooling pattern will not be able to be maintained. In particular, when the feed water pressure becomes low, air invades the path of circulation of water and the mist spray becomes unstable in a so-called "second wind" phenomenon, therefore the cooling becomes extremely unstable. To deal with this situation, it is sufficient to control the amount of feed air and its pressure at the source of the air feed system, but this would involve a large time lag and in the end a surplus amount of air and uneven cooling.

Figure 2:
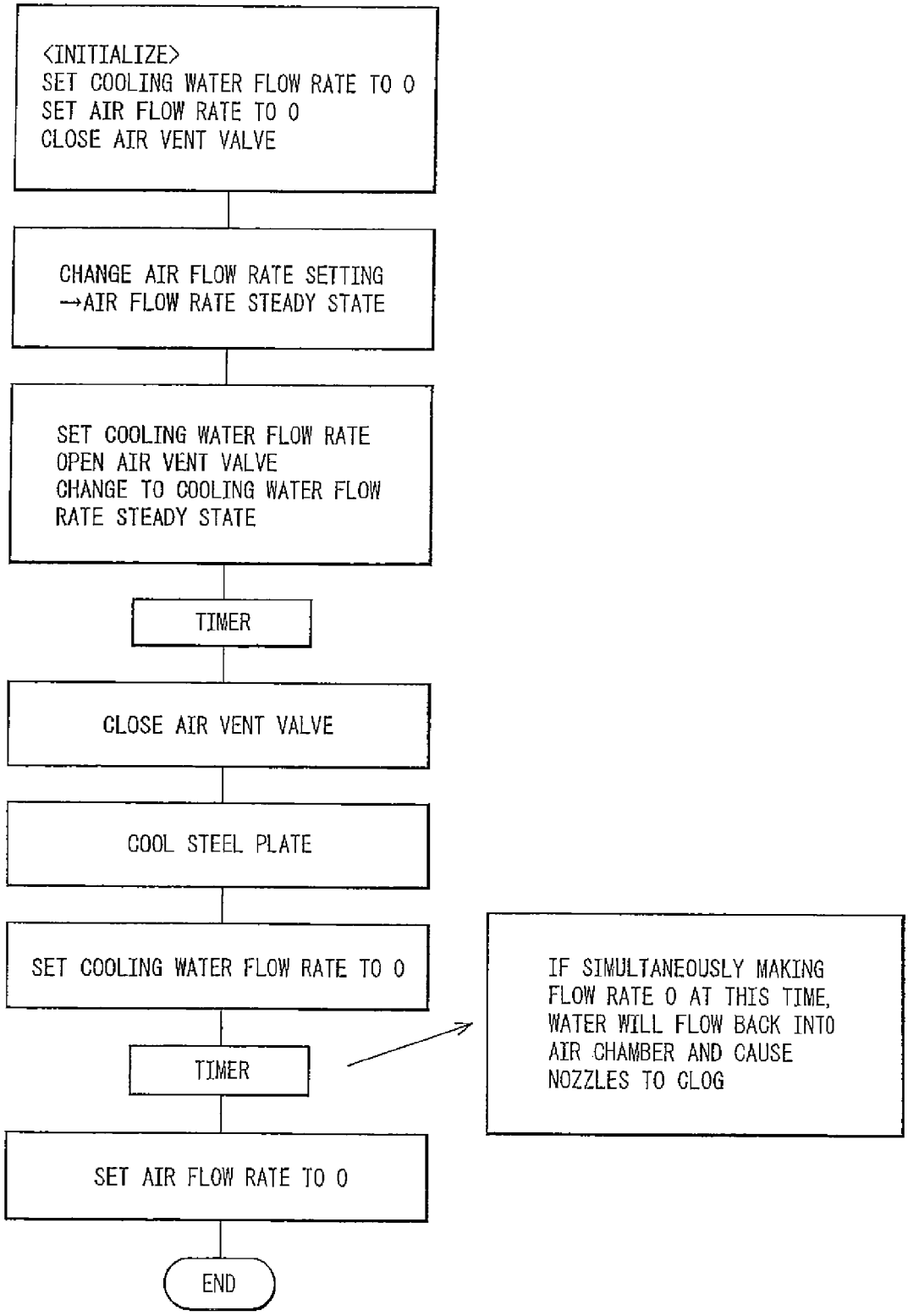
FIG. 2 is a view showing the flow of control of a steel plate cooling method according to the present invention.

Therefore, in the present invention, when such a situation arises, control is performed to drive out the air invading the flow path reaching the cooling apparatus, that is, the front ends of the nozzles, and make the ratio of mixture of the cooling water and air constant. As the specific control routine, as shown by the flow of control of FIG. 2, first, in the initial settings of a fluid nozzle control mechanism (not shown) directly connected to the cooling apparatus unit shown in FIG. 1, the cooling water flow rate is set to 0, the air flow rate is set to 0, and the air vent valve is closed. Next, the setting of the air flow rate is changed to set the air flow rate to the steady state. After this, when setting the flow rate of the cooling water, the air vent valve is opened, simultaneously the cooling water flow rate is set to the steady state, air passes from the feed pipes of the water to the water header, the state of the spray from the nozzles becomes stable, and the air vent valve is closed. To secure the time for this, a timer may be used. In this state, the cooling of the steel plate is started and control of cooling of the steel plate in the steady state is performed.

Further, after the steel plate finishes being cooled, first the circulation of the water is stopped, then the circulation of the air is stopped. This is because if simultaneously stopping the water and air, water would flow back to the air header side, water would invade the path of circulation of the air, and rust and other problems would arise. That is, if making the flow rate of cooling water zero (0) once and at that point of time operating the apparatus so that the flow rate of air becomes zero (0), cooling water would flow back to the air chamber (air reservoir) and the nozzles would clog, so usually the cooling water feed system is adjusted by a timer to make the air flow rate zero (0).

INDUSTRIAL APPLICABILITY

According to the present invention, it is possible to uniformly cool steel plate over its entire length without plate warping in controlled cooling of thick-gauge steel plate.

The invention claimed is:

1. A cooling apparatus for mixing and spraying air and water to cool a steel plate, wherein the cooling apparatus provides a stable spray pattern and prevents a second-wind phenomenon, comprising:

an air reservoir formed at an air spray surface of an air header, wherein the air header comprises a plurality of air feed pipes arranged at the air reservoir;

a cooling water reservoir formed around a plurality of cooling water spray nozzles in a water header, wherein the cooling water spray nozzles are connected to the air header;

a cooling water feed pipe; and a fluid nozzle control mechanism;

wherein each water spray nozzle has an air introduction port at its top, cooling water introduction ports at a portion of the nozzle body, and a discharge port for spraying air and water at its bottom, wherein an area around the cooling water introduction ports of said cooling water spray nozzles forms the water header, wherein the cooling water feed pipe has an outlet positioned below the water introduction ports of the cooling water spray nozzles, and wherein an air vent valve is provided in a middle of said cooling water feed pipe.

* * * * *